United States Patent [19]

Sacks et al.

[11] Patent Number: 4,663,798

[45] Date of Patent: May 12, 1987

[54] APPARATUS FOR WRINGING THE STRANDS OF MOPS

[75] Inventors: Dieter Sacks, Uerikon; Hans Mönch, Küsnacht, both of Switzerland

[73] Assignee: Interpat Limited, London, England

[21] Appl. No.: 798,482

[22] Filed: Nov. 15, 1985

[30] Foreign Application Priority Data

Nov. 17, 1984 [DE] Fed. Rep. of Germany ... 8433865[U]

[51] Int. Cl.[4] ..... A47L 13/58

[52] U.S. Cl. ..... 15/261

[58] Field of Search ..... 15/260, 261

[56] References Cited

U.S. PATENT DOCUMENTS

| | | | |
|---|---|---|---|
| 1,128,083 | 2/1915 | Welch | 15/261 |
| 2,802,233 | 8/1957 | Eberly et al. | 15/261 |
| 3,452,379 | 7/1969 | Bard | 15/261 X |

FOREIGN PATENT DOCUMENTS

| | | | |
|---|---|---|---|
| 1090194 | 11/1967 | United Kingdom | 15/261 |

*Primary Examiner*—Edward L. Roberts

*Attorney, Agent, or Firm*—Peter K. Kontler

[57] ABSTRACT

An apparatus for wringing the strands of mops has a housing which supports two lateral carriers for a set of horizontal wringing elements which are installed in the housing and are movable toward and away from the inner side of the front wall of the housing. The wringing elements are pivotable within limits about horizontal axes and have limited freedom of upward and downward movement relative to the lateral walls of the housing so that they can conform the orientation of their profiled front sides to the outlines of adjacent portions of a pile of strands which are introduced into the housing between the front wall and the wringing elements while the carriers maintain such elements in retracted positions. The carriers are formed with horizontal toothed racks mating with gear segments which are rotatably mounted in the housing and can be rotated by a pivotable lever so as to move the carriers and the wringing elements toward or away from the front wall. The end portions of the wringing elements have followers which extend through horizontal slots in the lateral walls of the housing and into bearings provided on the two carriers.

13 Claims, 3 Drawing Figures

APPARATUS FOR WRINGING THE STRANDS OF MOPS

BACKGROUND OF THE INVENTION

The present invention relates to apparatus for wringing the strands of mops or similar cleaning implements.

A wringing apparatus for the strands of mops comprises a housing which can receive the liquid-carrying strands of a mop, and a mechanism which can move a squeezing element against the strands so that the strands are squeezed to be thereby relieved of moisture. In accordance with a presently known proposal, the housing of the wringing apparatus includes a substantially U-shaped member and the means for squeezing the strands comprises a flat one-piece biasing element which is movable from the open side toward the web of the U-shaped member to thereby urge the strands against the web. The mechanism for moving the biasing element with reference to the U-shaped member comprises a system of levers and/or links. The biasing element can be said to constitute the mobile fourth wall of the housing (the other three walls are the legs and the web of the U-shaped member). Such apparatus are simple and rather inexpensive; however, their squeezing or wringing action is not entirely satisfactory, especially if the strands of the mops are formed with knots and/or other irregularities which prevent the flat one-piece biasing element from contacting the major portions of strands in the space between the biasing element and the web of the U-shaped member. The irregularities of the strands determine the extent to which the biasing element can be moved toward the web of the U-shaped member and a substantial portion of each strand is likely to retain moisture when the wringing operation is completed.

Another drawback of the just described conventional wringing apparatus is that their moisture-expelling action is overly dependent on the orientation of strands which are inserted into the housing before the biasing element is moved from its retracted position. Thus, the user of the mop must be careful to introduce the strands in such a way that they are at least substantially parallel to each other and to the web of the U-shaped member because only such orientation ensures the expulsion of substantial quantities of the absorbed liquid provided, of course, that the strands are devoid of knots and like protuberances. Such careful introduction of strands into the housing takes up time and is not to be expected from the user, be it a housewife, a maid, a janitor or any other person in charge of sweeping floors or performing similar duties.

A further drawback of the aforedescribed apparatus is that each actuation of the mechanism for moving the biasing element necessitates the exercise of a substantial effort which is tiresome to the operator and often prevents an elderly or infirm person whom expelling adequate quantities of absorbed liquids, i.e., the wringing operation must be repeated at frequent intervals.

OBJECTS AND SUMMARY OF THE INVENTION

An object of the invention is to provide a wringing apparatus which can expel large quantities of liquids from simple strands as well as from strands which are provided with knots and/or other irregularities.

Another object of the invention is to provide the apparatus with novel and improved means for contacting and squeezing the strands in the housing.

A further object of the invention is to provide the apparatus with a novel and improved mechanism which serves to move various parts relative to the housing and whose mechanical advantage is more satisfactory than that of mechanisms in conventional wringing apparatus.

An additional object of the invention is to provide an apparatus which is not only compact, simple, inexpensive and rugged but is also capable of expelling large quantities of moisture, even if the strands are introduced into the housing in random distribution rather than in substantial parallelism with one another.

Still another object of the invention is to provide novel and improved means for guiding the movable parts of the above outlined wringing apparatus.

A further object of the invention is to provide an apparatus which is sufficiently compact to be installed in or on a standard pail, barrel or other receptacle for collection of expelled liquids.

The invention is embodied in an apparatus for wringing the strands of mops. The apparatus comprises a housing which defines a chamber for reception of strands and has a front wall which flanks a portion of the chamber, carrier means mounted on the housing for movement toward and away from the front wall, a squeezing or wringing unit including a plurality of squeezing elements which are mounted on the carrier means, which are disposed in the chamber and at least one of which has limited freedom of movement relative to the carrier means so that it can more readily conform to the outline of the pile of strands which are introduced into the housing between the front wall and the squeezing elements, and means for moving the carrier means relative to the housing so that the strands between the front wall and the squeezing elements are urged against the wall in response to movement of the carrier means from its retracted position (remote from the front wall) toward its extended position (closer to the front wall).

The carrier means preferably includes bearing means defining for the one squeezing element a pivot axis which extends substantially transversely of the directions of movement of the carrier means relative to the front wall.

In accordance with a presently preferred embodiment of the invention, the squeezing or wringing unit comprises three preferably equidistant and preferably elongated substantially horizontal squeezing elements, and the inner side of the front wall is vertical or substantially vertical so that the inserted strands can extend along such inner side by gravity preparatory to movement of the squeezing elements toward the front wall.

The housing preferably further comprises two upright additional (lateral) walls which flank the front wall and additional portions of the chamber in the housing. At least one sidewall is preferably provided with guide means for each of the squeezing elements and such elements are then provided with follower means which track the respective guide means. Each guide means can be formed with an elongated (preferably horizontal or nearly horizontal) slot which extends transversely of the respective lateral wall, and each of the follower means can comprise a pin which extends into the respective slot, preferably with at least some play transversely of the longitudinal direction of the slot.

The carrier means can comprise bearing means for several squeezing elements or for each squeezing element, i.e., each of two or more squeezing elements can be mounted for pivotal movement about an axis which extends transversely of the front wall between the two lateral walls and enables the respective squeezing element to conform its orientation to the outline of the adjacent portion of the pile of strands in the housing.

The carrier means can comprise two spaced-apart sections, one adjacent to the outer side of each of the lateral walls, and the squeezing elements are then disposed between the two sections in the interior of the housing (i.e., between the inner sides of the lateral walls). The moving means can comprise a toothed rack on at least one of the sections, a pinion (e.g., a gear segment) which is rotatably journalled in the housing and meshes with the toothed rack, and a lever or other suitable means for rotating the pinion with reference to the housing. The lateral walls can be provided with ways (e.g., with ways having substantially horizontal recesses or cutouts) for the respective sections of the carrier means. In accordance with a presently preferred embodiment of the invention, the moving means comprises a discrete toothed rack on each section of the carrier means, a discrete pinion for each of the two racks, and means (such as a horizontal shaft) which causes the two pinions to rotate as a unit about a common axis in response to actuation of the rotating means.

Each squeezing element is preferably provided with a profiled front side which faces the front wall and comes into contact with the strands in the housing in response to movement of the carrier means toward the inner side of the front wall. Such front sides can be provided with elongated ribs which extend transversely of the front wall and contribute to the liquid-expelling action of the squeezing elements.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 3:
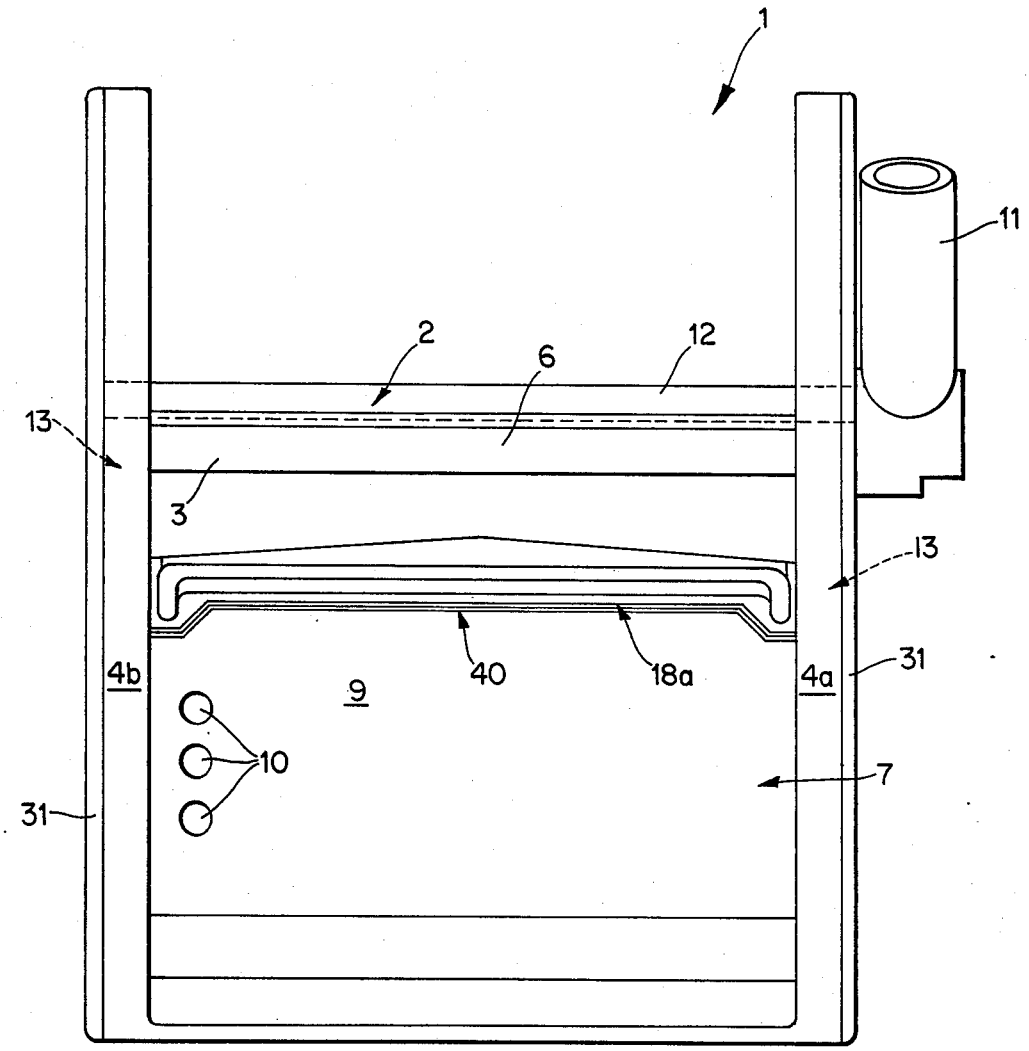
FIG. 3 is a plan view of the apparatus which is shown in FIGS. 1 and 2.

The improved wringing apparatus 1 comprises a housing 2 whose top is open and which includes a front wall 5, two additional or lateral walls 4*a*, 4*b* and a rear wall 3. The housing 2 has a substantially rectangular outline (see FIG. 3) and its walls define a chamber 7 which extends from the inner side of the front wall 5 to the inner side of the rear wall 3 and is flanked by the lateral walls 4*a*, 4*b*. A portion of a mop 8 is indicated by phantom lines in the left-hand portion of FIG. 1; the elongated liquid-absorbing strands 8*a* of such mop are introduced between the inner side of the front wall 5 and a set of three horizontal elongated equidistant wringing or squeezing elements 18*a*, 18*b*, 18*c* which are installed in the chamber 7 and extend transversely of the front wall 5, i.e., between the lateral walls 4*a*, 4*b*. Portions of the lateral walls 4*a*, 4*b* extend beyond the outer side 6 of the rear wall 3 and define a space for a portion of a lever 11 forming part of the means 13 for moving the elements 18*a*–18*c* in directions toward and away from the inner side of the front wall 5.

Figure 1:
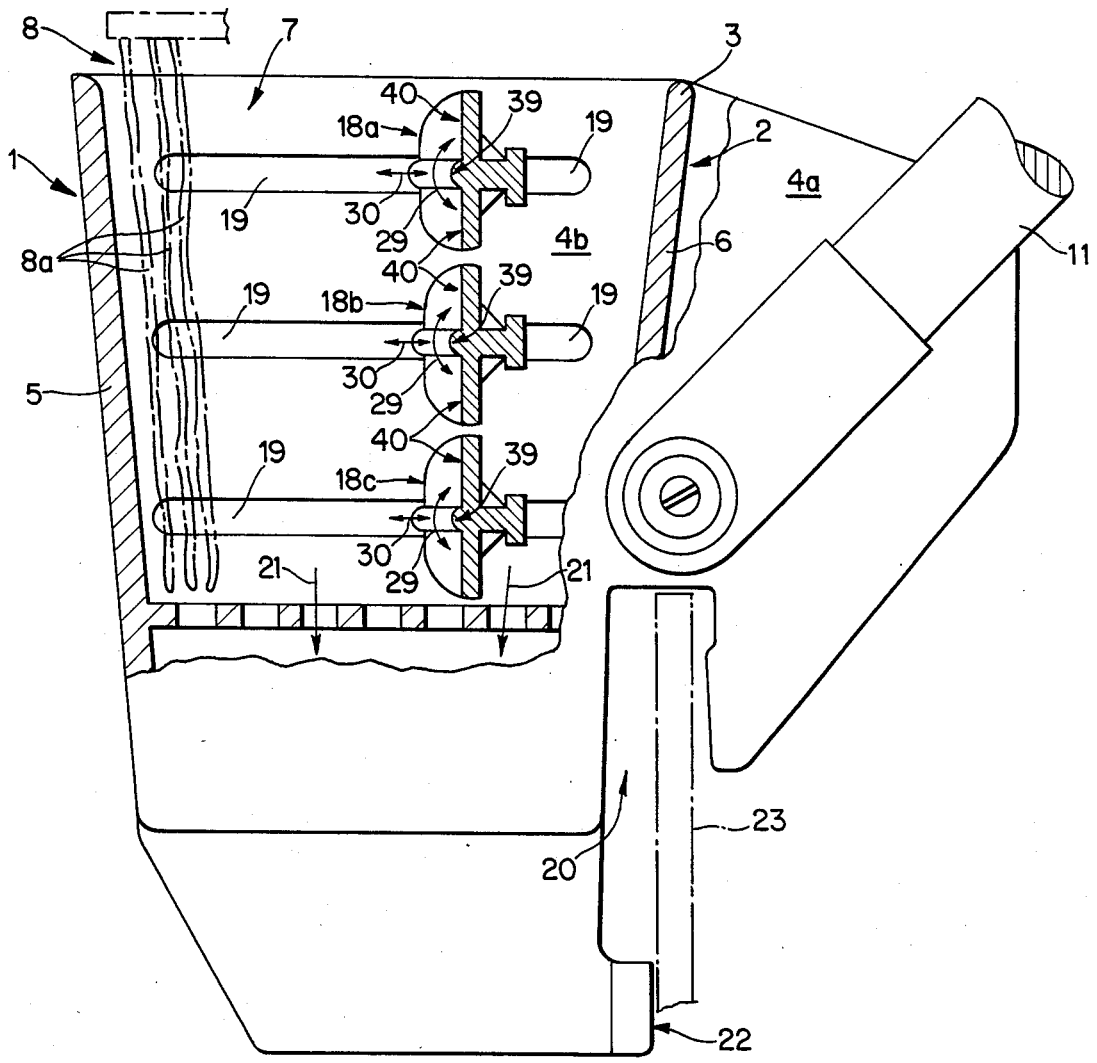
FIG. 1 is a fragmentary side elevational view of an apparatus which embodies the invention, a portion of one of the sidewalls of the housing being broken away and the squeezing elements being shown in retracted positions.
Figure 2:
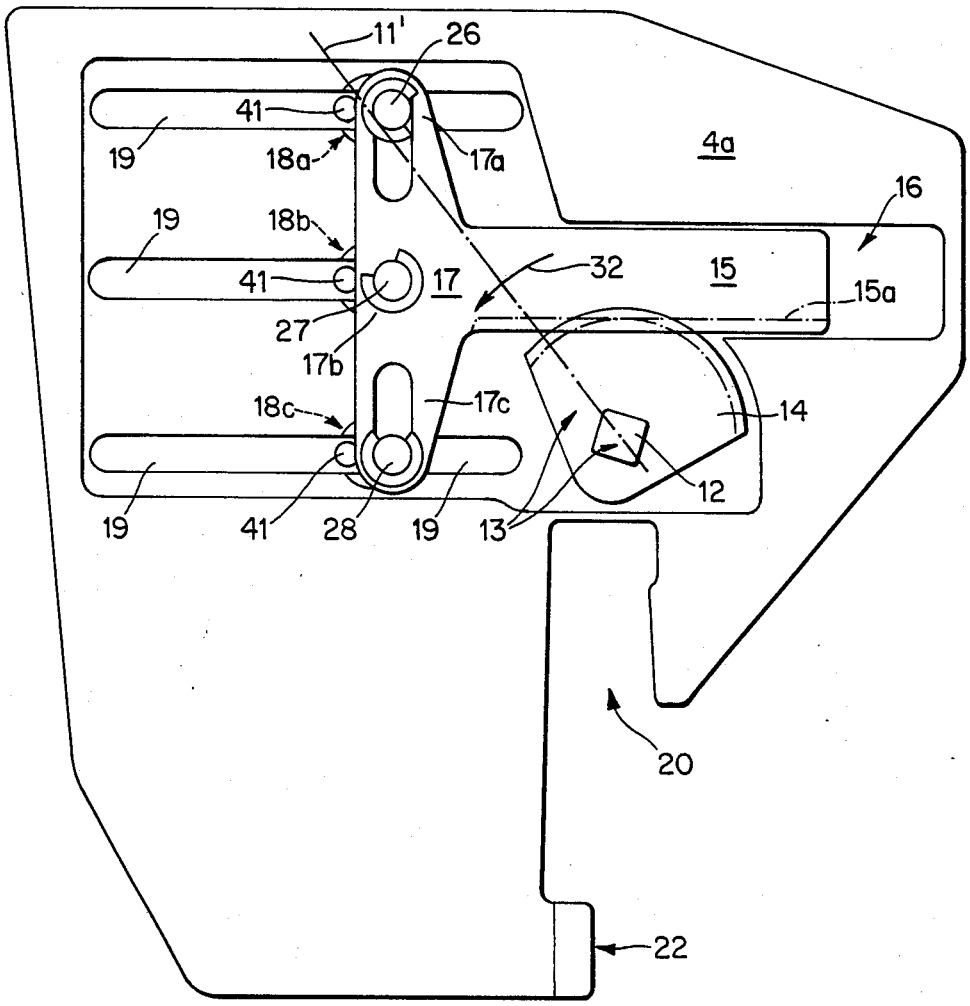
FIG. 2 is a similar side elevational view of the apparatus and shows one section of the carrier means, with the shroud for the one section removed.

The purpose of the elements 18*a*–*c* is to bias the strands 8*a* of the mop 8 against the front wall 5 and to thereby expel the absorbed liquid which flows downwardly toward and through the apertures 10 of a horizontal bottom wall 9 of the housing 2. The direction in which the liquid flows from the chamber 7 is indicated by the arrows 21, and such liquid can gather in a pail 23, a bucket, a barrel or a like receptacle for dirty liquid. As shown in FIGS. 1 and 2, the lateral walls 4*a* and 4*b* further comprise extensions that project downwardly beyond the underside of the bottom wall 9 and have aligned notches 20 for the marginal portion of the pail 23. The latter abuts against stops 22 which are provided on the extensions of the lateral walls 4*a*, 4*b* so that the housing 2 is reliably held in the pail while the user manipulates the lever 11 in order to move the elements 18*a*–18*c* from the retracted positions of FIG. 1 toward the front wall 5 and to thereby wring the strands 8*a* with a force which suffices to expel the major percentage of absorbed liquid. In order to move the elements 18*a*–18*c* toward the front wall 5, the lever 11 must be pivoted in a counterclockwise direction, as viewed in FIG. 1, so that the stops 22 of the lateral walls 4*a*, 4*b* bear against the inner side of the pail 23. This reduces the likelihood of overturning of the pail in the course of the wringing operation.

The mop 8 can be of conventional construction, i.e., it can have elongated strands which are devoid of knots or other protuberances and/or irregularities so that such strands can be readily pressed against the inner side of the front wall 5 in a manner such as to ensure the expulsion of large quantities of liquid (normally dirty water which is gathered as a result of wiping a floor). In order to ensure that the elements 18*a*–*c* can expel large quantities of liquid from strands which are provided with knots or other types of irregularities, at least one of these elements is movably mounted on a composite carrier including two preferably identical mirror symmetrical sections 17 one of which is outwardly adjacent to the lateral wall 4*a* and the other of which is outwardly adjacent to the lateral wall 4*b*. Of course, the strands 8*a* can also carry clean or reasonably clean water, e.g., when the wringing operation is carried out to clean the strands rather than to expel liquids which were wiped off a floor or the like.

The number of wringing or squeezing elements can be reduced to two or even one, or increased to four or more. It is presently preferred to employ a wringing unit which comprises three elements 18*a*, 18*b*, 18*c* because such number suffices to ensure highly satisfactory expulsion of liquids from the strands 8*a* of a mop and also because three elements do not occupy too much room in the chamber 7 so that the apparatus 1 can be provided with a relatively small housing.

The end portions of the elements 18*a*–18*c* are respectively provided with stub shafts 26, 27, 28 which extend through slots 19 in the walls 4*a*, 4*b* and into suitably configurated bearings 17*a*, 17*b*, 17*c* of the respective sections 17 of the carrier. At least one of the elements 18*a*–18*c* is pivotable about the common horizontal axis of the respective shafts 26, 27, 28. In the illustrated apparatus, each of the three elements 18*a*–18*c* can pivot about a horizontal axis and each such element has limited freedom of angular movement relative to the two sections 17. This enables the profiled front sides 40 of the elements 18*a*–18*c* to assume orientations which are best suited to ensure the expulsion of large quantities of liquids when the lever 11 is pivoted in a direction to move the sections 17, and hence the elements 18*a*–18*c*, toward the inner side of the front wall 5. The directions in which the elements 18*a*–18*c* are pivotable about the axes of the respective pairs of stub shafts 26, 27, 28 are indicated by double-headed arrows 29. The arrows 30 denote the directions in which the elements 18*a*–18*c* are movable toward and away from the front wall 5. The lateral walls 4*a*, 4*b* have portions which constitute guide means for the elements 18*a*–18*c* and are formed with the aforementioned elongated horizontal slots 19 for the respective stub shafts as well as for pin-shaped followers 41 of the corresponding squeezing or wringing elements. The width of the slots 19 exceeds the diameters of the respective followers 41 so that each of the followers has a limited freedom of vertical movement in the corresponding guide means, i.e., relative to the lateral walls 4*a* and 4*b*. Such mounting of the elements 18*a*–18*c* on the sections 17 of the carrier and in the lateral walls 4*a*, 4*b* enables their front sides 40 to readily assume optimum positions for engagement with straight strands 8*a*, with strands which partially overlie each other as well as with strands which exhibit pronounced irregularities in the form of knots or the like. The diameters of the followers 41 and the widths of the slots 19 determine the extent of pivotability of the elements 18*a*–18*c*. The pivotability of each of these elements may but need not be the same. For example, the pivotability of the element 18*a* can exceed that of the element 18*c* or vice versa.

When the elements 18*a*–18*c* are spaced apart from the strands 8*a*, their front sides 40 are located in a substantially vertical plane and their horizontal ribs 39 extend toward the front wall 5. Each of the front sides 40 can be provided with two or more straight ribs 39 and/or with one or more undulate and/or otherwise configurated ribs or analogous projections. All this contributes to a more satisfactory liquid expelling action of the elements 18*a*–18*c*.

The means 13 for moving the sections 17 of the carrier for the elements 18*a*–18*c* toward and away from the front wall 5 of the housing 2 further comprises a horizontal shaft 12 which has polygonal portions (see FIG. 2) for two pinions 14 in the form of gear segments whose teeth mate with the teeth 15*a* of two elongated horizontal racks 15 on the respective sections 17 of the carrier. The racks 15 are guided in elongated recesses or cutouts 16 provided in those portions (ways) of the lateral walls 4*a*, 4*b* which extend rearwardly beyond the outer side 6 of the rear wall 3. While a single pinion 14 and a single toothed rack 15 would suffice to ensure the transmission of motion from the lever 11 to the sections 17 of the carrier for the elements 18*a*–18*c*, the provision of two toothed racks and two pinions is preferred because such construction of the moving means 13 reduces the likelihood of jamming of the pin-shaped followers 41 of elements 18*a*–18*c* in the respective slots 19. The sections 17 of the carrier are normally concealed behind plate-like shrouds 31 which are outwardly adjacent to the lateral walls 4*a* and 4*b* (see FIG. 3).

In FIG. 1, the starting or normal position of the lever 11 is moved clockwise through approximately 60 degrees for the sake of clarity. The actual starting position of the lever 11 is shown in FIG. 2 by the phantom line 11'. The operator pivots the lever 11 counterclockwise (arrow 32 in FIG. 2) from the position 11' in order to move the elements 18*a*–18*c* toward the inner side of the front wall 5 and into engagement with the strands 8*a* while such strands extend into the chamber 7. The mechanical advantage of the moving means 13 is highly satisfactory, i.e., the operator need not exert a pronounced force in order to expel large quantities of absorbed liquid from the strands 8*a* while such strands bear against the front wall 5. The expelled liquid flows through the apertures 10 of the bottom wall 9 and into the pail 23.

The ribs 39 of the profiled front sides 40 of the elements 18*a*–18*c* are preferably located at the levels of the respective pairs of slots 19 in the lateral walls 4*a* and 4*b*. The clearances with which the pin-shaped followers 41 of the elements 18*a*–18*c* are received in the corresponding slots 19 are sufficiently small to ensure that the front sides 40 are normally maintained in substantially vertical planes but the clearances should suffice to enable the front sides 40 to conform their orientation to the adjacent portions of the pile of strands 8*a* even if such strands are provided with knots or the like. The pivot axes for the elements 18*a*–18*c* are defined by the respective pairs of stub shafts 26, 27, 28.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for wringing the strands of mops, comprising a housing defining a strand-receiving chamber and having a substantially upright front wall flanking a portion of said chamber; carrier means mounted on said housing for movement along a substantially horizontal path toward and away from said wall; a squeezing unit including a plurality of squeezing elements mounted on said carrier means and disposed in said chamber; at least one of said elements having limited freedom of movement relative to said carrier means; and means for moving said carrier means along said path relative to said housing so that the strands which are introduced into said chamber and extend downwardly between said wall and said elements are engaged by said elements and are urged against said wall in response to movement of said carrier means toward said wall.

2. The apparatus of claim 1, wherein said carrier means includes bearing means defining for said one element a pivot axis extending substantially transversely of the directions of movement of said carrier means toward and away from said wall.

3. The apparatus of claim 1, wherein said squeezing unit comprises three squeezing elements.

4. The apparatus of claim 1, wherein said chamber has additional portions and said housing comprises two additional walls flanking said additional portions of said chamber, said front wall being disposed between said additional walls and at least one of said additional walls having guide means for each of said squeezing elements, said elements having follower means tracking the respective guide means.

5. The apparatus of claim 4, wherein each of said guide means has a substantially horizontal elongated slot in the respective additional wall, each of said follower means extending into the respective slot.

6. The apparatus of claim 5, wherein said carrier means includes bearing means for several of said elements and each of said bearing means defines for the respective element a pivot axis extending substantially transversely of the directions of movement of said carrier means toward and away from said front wall, said follower means having limited freedom of movement substantially transversely of the respective slots.

7. The apparatus of claim 6, wherein said follower means include pins.

8. The apparatus of claim 1, wherein said carrier means includes two spaced-apart sections and said elements are disposed between said sections, said moving means including a toothed rack on at least one of said sections, a pinion rotatably journalled in said housing and mating with said rack, and means for rotating said pinion.

9. The apparatus of claim 8, wherein said chamber has additional portions and said housing comprises two additional walls flanking said additional portions of said chamber and said front wall, each of said additional walls having ways for one of said sections.

10. The apparatus of claim 8, wherein said moving means comprises a toothed rack on each of said sections and a pinion for each of said racks, said rotating means comprising means for rotating said pinions about a common axis.

11. The apparatus of claim 1, wherein said chamber has additional portions and said housing comprises two additional walls flanking said front wall and said additional portions of said chamber and each having a substantially horizontal elongated slot for each of said elements, each of said elements having two pin-shaped followers extending with clearance into the respective slots of said additional walls.

12. The apparatus of claim 1, wherein each of said elements has a profiled front side facing toward said wall and movable into contact with the strands in said housing in response to movement of said carrier means toward said wall.

13. The apparatus of claim 12, wherein at least one of said front sides has at least one elongated rib extending substantially transversely of said front wall.

* * * * *